US006073474A

United States Patent [19]

Dittmar

[11] Patent Number: 6,073,474

[45] Date of Patent: Jun. 13, 2000

[54] "C" BLOCK ROLL BENDING

[75] Inventor: Robert William Dittmar, Allison Park, Pa.

[73] Assignee: Danieli United, a divison of Danieli Corporation, Cranberry Township, Pa.

[21] Appl. No.: 09/339,526

[22] Filed: Jun. 24, 1999

[51] Int. Cl.[7] ..... B21B 13/14; B21B 29/00; B21B 31/07

[52] U.S. Cl. ..... 72/241.8; 72/240

[58] Field of Search ..... 72/238, 239, 241.8, 72/241.2, 241.4, 240, 248

[56] References Cited

U.S. PATENT DOCUMENTS

| | | | |
|---|---|---|---|
| 3,171,304 | 3/1965 | Sims et al. | 80/1 |
| 3,228,219 | 1/1966 | Fox | 72/16 |
| 3,747,387 | 7/1973 | Shumaker | 72/239 |
| 4,238,947 | 12/1980 | Graham et al. | 72/237 |
| 4,898,014 | 2/1990 | Ginzburg et al. | 72/247 |
| 5,638,716 | 6/1997 | Jonen | 72/241.8 |

FOREIGN PATENT DOCUMENTS

| | | | |
|---|---|---|---|
| 1-5612 | 1/1989 | Japan . | |
| 2202173 | 9/1988 | United Kingdom | 72/241.8 |

*Primary Examiner*—Rodney A. Butler

*Attorney, Agent, or Firm*—Armstrong, Westerman, Hattori, McLeland & Naughton

[57] ABSTRACT

A work roll bending system for profile control of continuous metal strip during rolling which is especially useful for retrofitting an existing rolling mill absent such feature to provide it with roll bending capabilities. The advantage of the system is its compactness in the vertical direction which facilitates its positioning between housing posts of the rolling mill where space in the vertical direction is often limited. Bending wings for exerting bending forces to work roll chocks with use of hydraulic cylinder and piston assemblies extend from the chocks in an intermeshing manner to allow wings from top and bottom work roll chocks to occupy the same horizontal plane without interference during at least some roll gap settings. That bending wing arrangement also allows for elimination of a "layer" of hydraulic cylinder and piston assemblies which also reduces space requirements in the vertical direction.

11 Claims, 6 Drawing Sheets

"C" BLOCK ROLL BENDING

BACKGROUND OF THE INVENTION

1. Field of the Invention

This invention relates to work roll bending in a continuous metal strip rolling mill to control strip profile during thickness gauge reduction.

2. Description of Related Art

Work roll bending in a vertical plane can be carried out in a positive or negative manner by applying forces to rotationally supporting chocks at each longitudinal end of top and bottom work rolls of a continuous metal strip rolling mill. So called "C", "E", Mae West and other type rolling mill blocks house pressure-exerting cylinder and piston assemblies which are combined with appropriately configured chocks to exert the bending forces on the work rolls. Most often such bending systems are within the confines of housing posts of the rolling mill stand and are confined in the vertical direction by top and bottom back-up roll chocks.

U.S. Pat. No. 3,228,219 describes roll bending wherein hydraulic means are disposed between work roll chocks and back-up roll chocks to achieve work roll bending in solely a negative manner.

U.S. Pat. No. 5,638,716 describes work roll bending in both a positive and a negative manner wherein modified "C" blocks are rigidly connected to the housing posts of the rolling mill.

Japanese patent No. 1-5612 (A) describes work roll chocks having two "fillets" projecting from each chock. The fillets are of a length, in the roll axial direction, less than the length of the chock in the same direction. Lengths and location of the fillets are such that when work rolls are brought into contact with each other the fillets come within about the same horizontal plane. Bending forces on the chocks are not symmetrical along the axial direction of each chock which can result in uneven wear and shortened service for bearing surfaces of the chocks.

SUMMARY OF THE INVENTION

The present invention provides a system for work roll bending, for application on rolling mills having limited space, especially in the vertical direction, between paired housing posts of a rolling mill. Such is commonly the case when retrofitting roll bending means on a 4 high (or higher) existing rolling mill not originally designed with work roll bending features.

Work roll chocks of the invention are configured with bending wings, each extending outwardly toward a neighboring housing post. The dimension of each wing in relation to the dimension of its chock in an axial direction of the supported work roll is such that the wings by-pass each other and do not interfere with each other when the work rolls are in position for rolling. The bending wings are located so as when bending forces are exerted on the chocks, through the wings, the forces on each chock are symmetrical along the axial direction so as to promote uniform wear of bearing surfaces within the chocks and thus increased length of service.

Other specific features and contributions of the invention are described in more detail with reference being made to the accompanying drawings.

DESCRIPTION OF THE INVENTION

Description of the invention is focused on work rolls of a 4-high rolling mill presenting a top and bottom work roll, each having an associated back up roll. The bending system of the invention, in its preferred embodiment, is within the confines of paired housing posts of the rolling mill stand which limit the available space horizontally, and back-up roll chocks which limit the available space vertically. Other rolling mill configurations wherein the benefits of such system can be applied are also possible. Prior practice bending systems are discussed to point out and compare the compactness of the invention which enables its use in applications where space, especially in the vertical direction, is limited.

Figure 1:
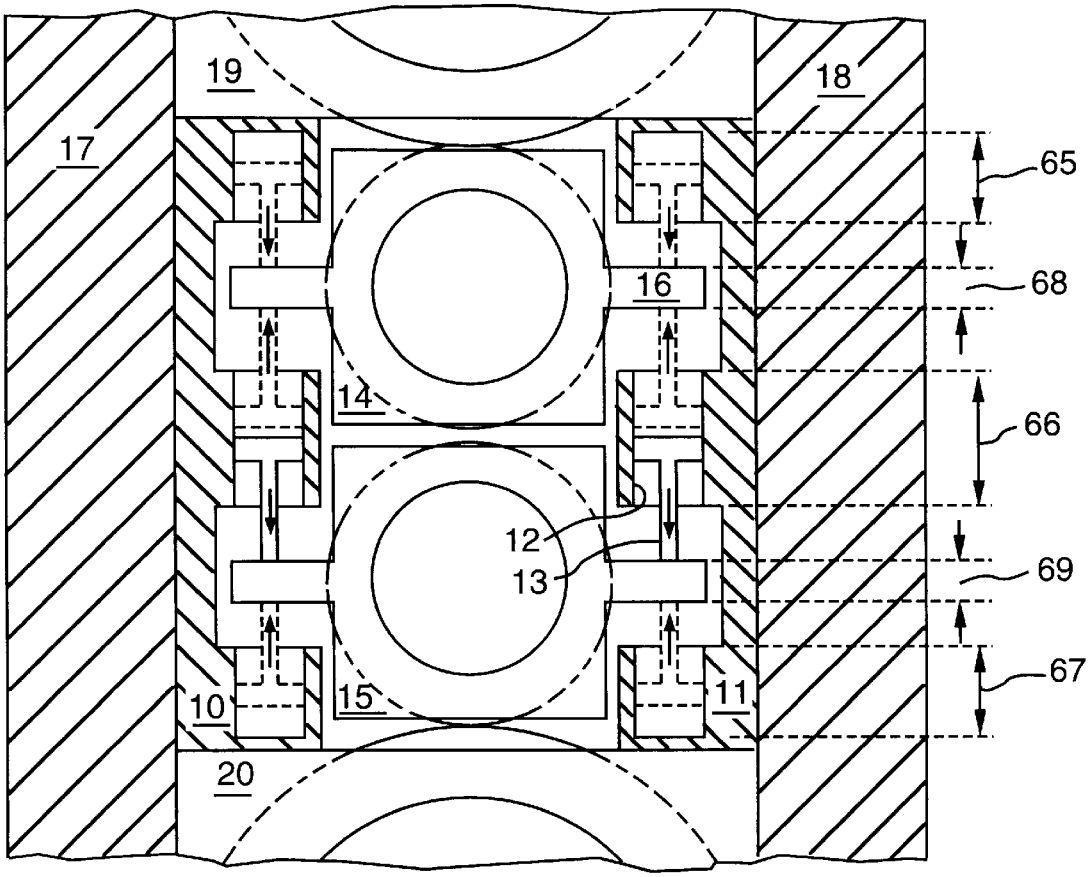
FIG. 1 Prior Art
FIG. 1 (prior art) is an end view, partly in section, of an "E" block work roll bending system.

FIG. 1 depicts a commonly referred to "E" block bending system featuring "E" blocks 10 and 11 housing hydraulic cylinders and pistons such as 12 and 13 respectively.

Upper work roll chock 14 and lower work roll chock 15 present bending wings, for example 16, extending generally, horizontally, upon which pistons act to carry out work roll bending. All such components are within a space bounded by paired housing posts 17 and 18, and back-up roll chocks 19 and 20.

Figure 2:
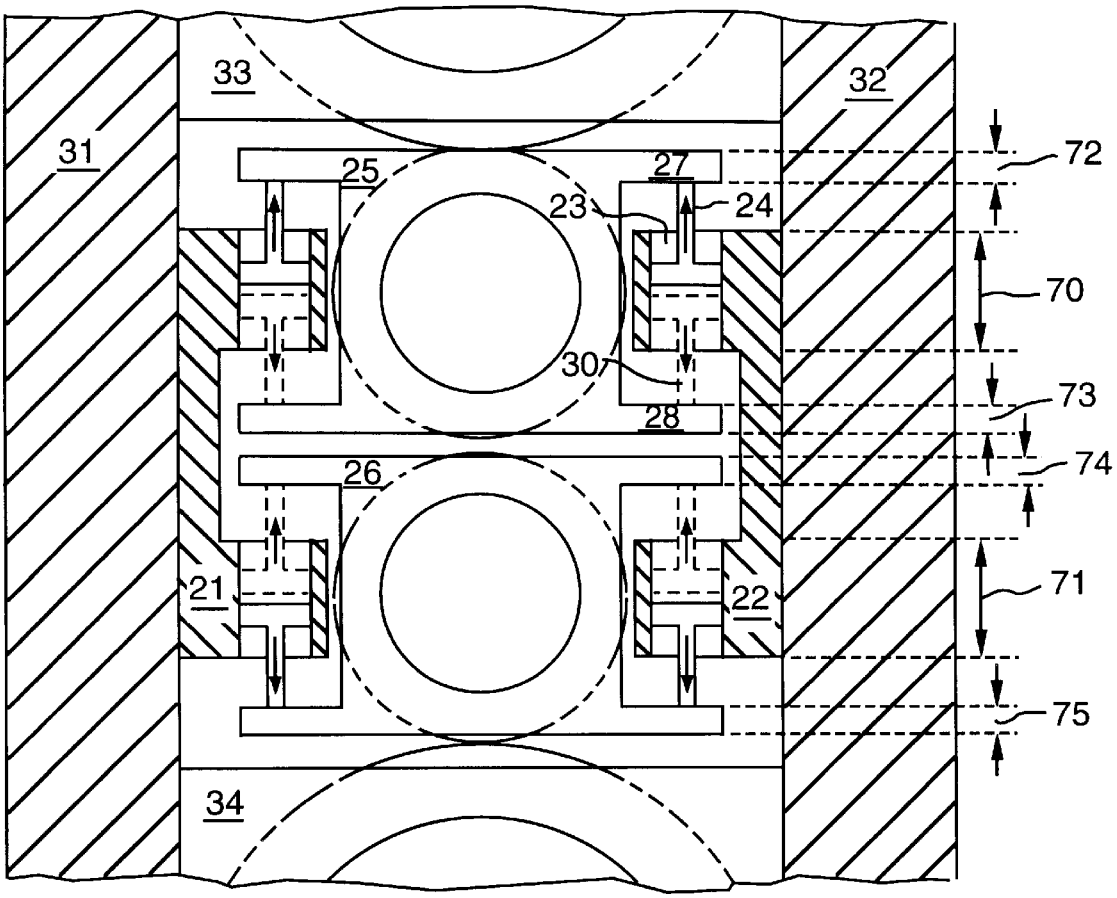
FIG. 2 Prior Art
FIG. 2 (prior art) is an end view, partly in section, of a "C" block work roll bending system.

FIG. 2 depicts a commonly referred to "C" block bending system. "C" blocks 21 and 22 house hydraulic cylinders and pistons such as 23 and 24 respectively. Upper work roll chock 25 and lower work roll chock 26 have paired bending wings, for example 27 and 28, upon which force provided by pistons 24 and 30 act in a vertical direction to bend the work rolls. The "C" block system is bounded by paired housing posts 31 and 32 and back-up roll chocks 33 and 34.

Figure 3:
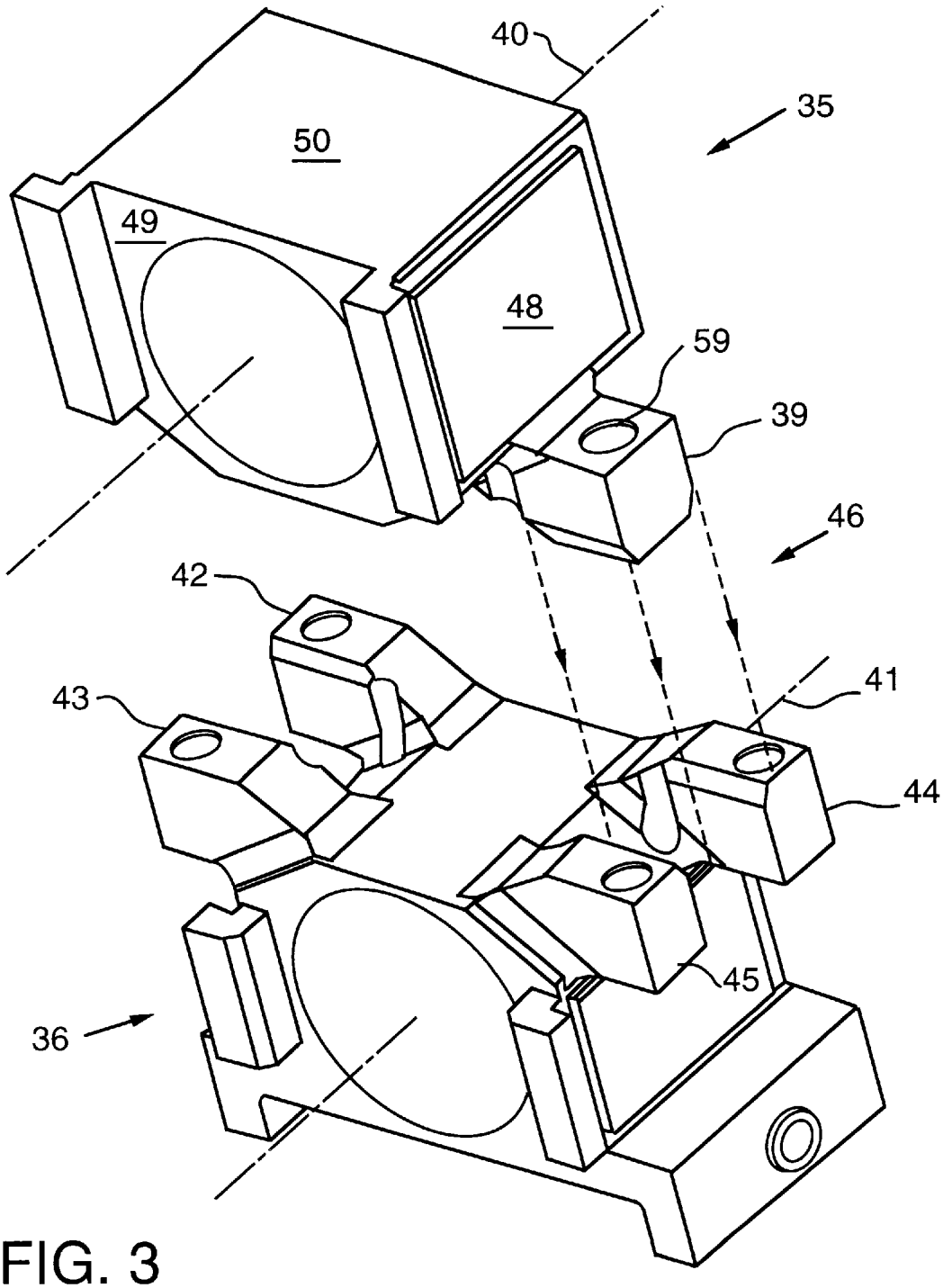
FIG. 3 is a perspective view of top and bottom chocks for the bending system of the invention.
Figure 4:
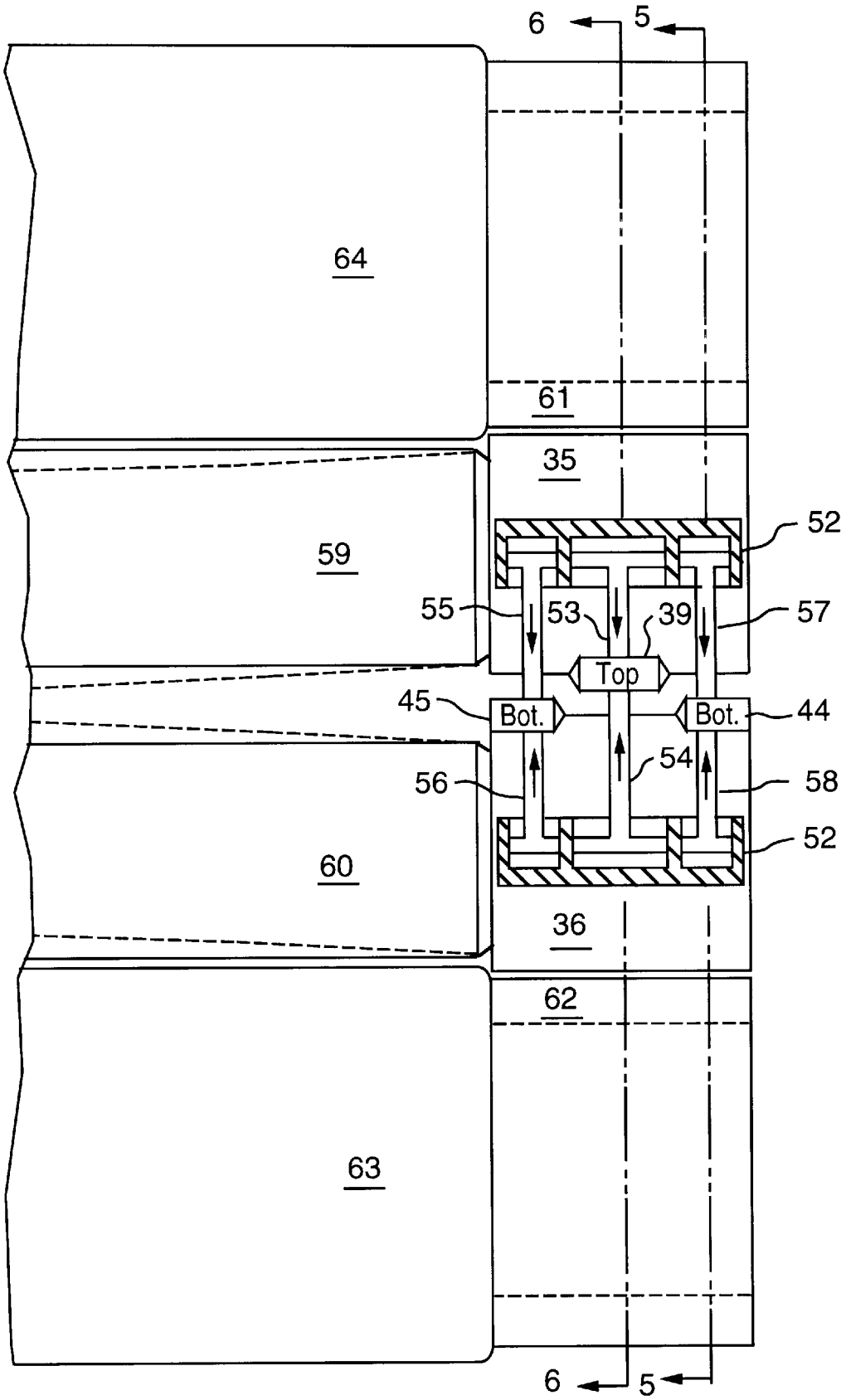
FIG. 4 is an elevational view, partly in section, of a "C" block work roll bending system of the invention.
Figure 5:
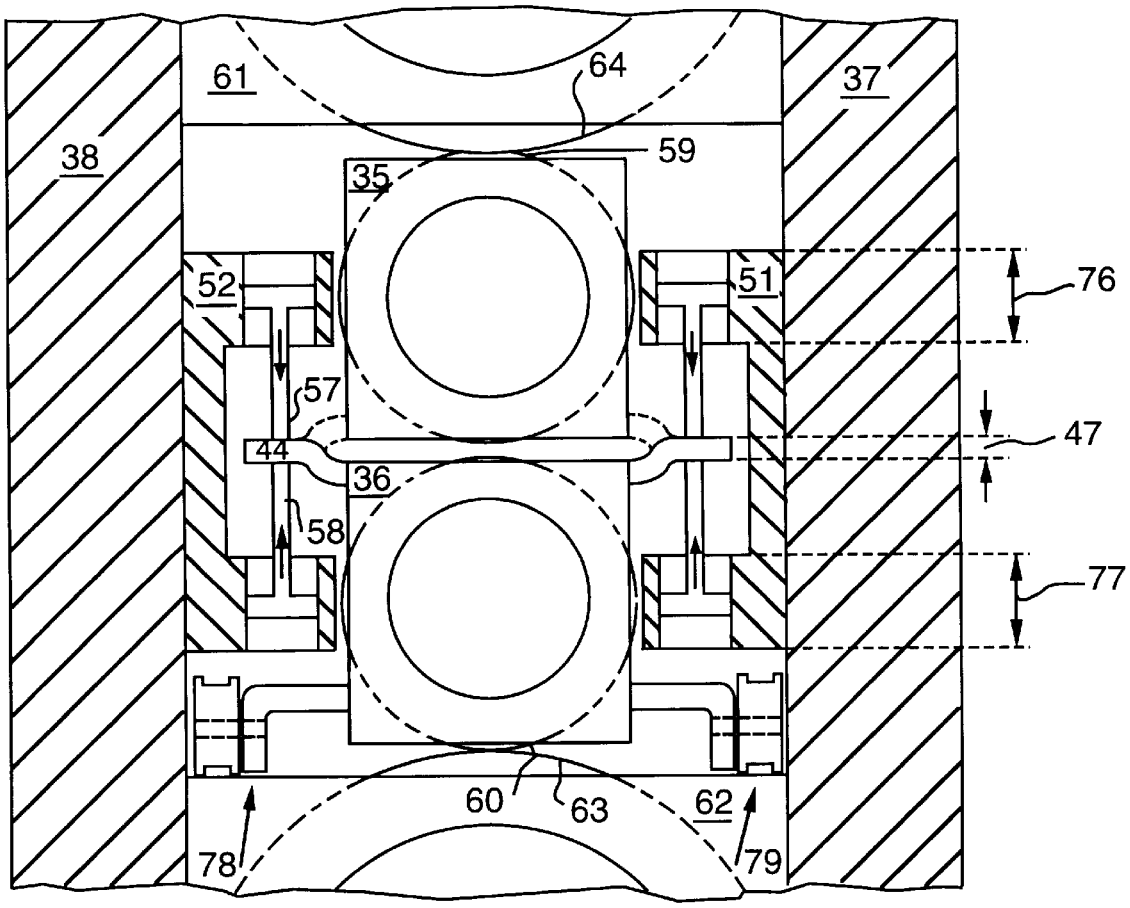
FIG. 5 is a sectional view of the "C" block work roll bending system taken on line 5—5 of FIG. 4 for describing bending force components for a bottom work roll of the invention.
Figure 6:
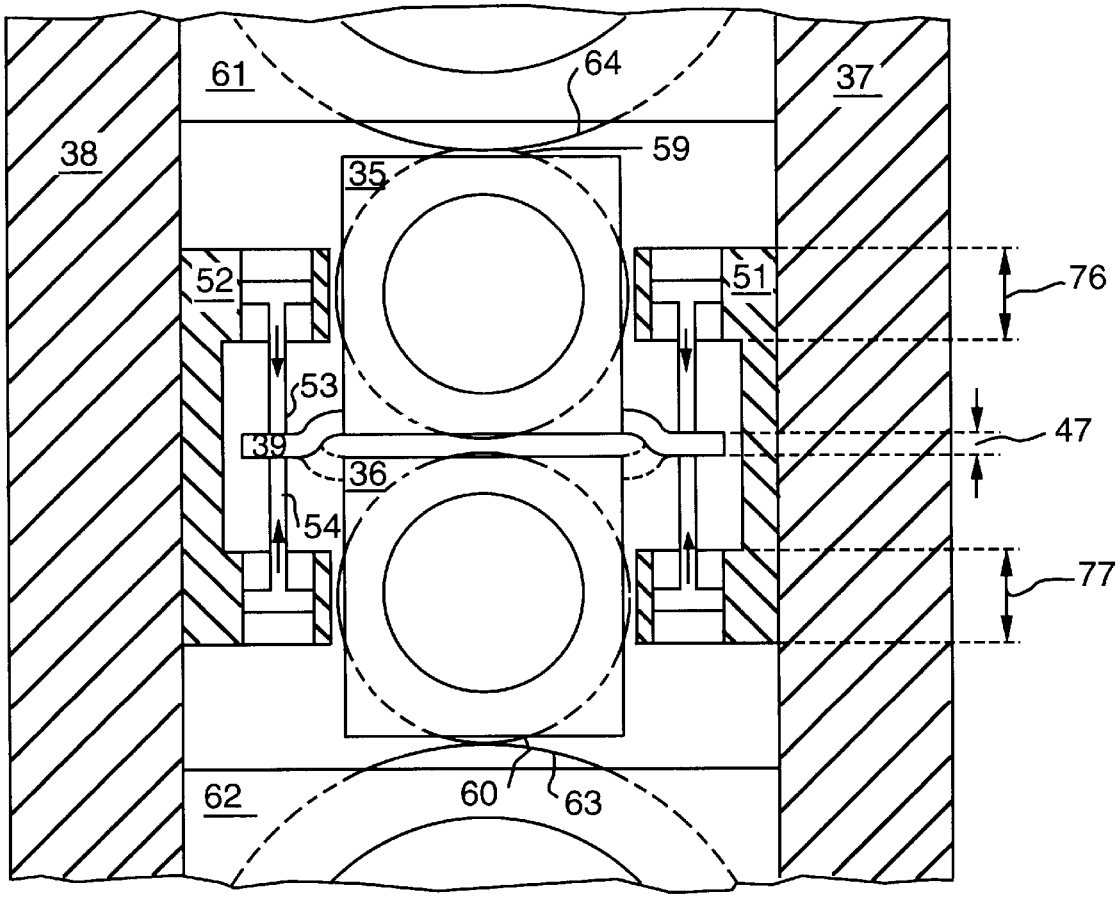
FIG. 6 is a sectional view, of the "C" block work roll bending system taken on line 6—6 of FIG. 4 for describing bending force components for a top work roll of the invention.

FIG. 3 depicts, in perspective view, work roll chocks of the invention; FIGS. 4–6 depict such chocks in elevational and cross-sectional end views as they relate to the system and to a rolling mill. In the following description of the invention, in some cases one of a plurality of similar components is described; it is to be understood that such description applies to all of the similar components. Although the bending system is depicted in the drawings at only one longitudinal end of the work rolls, similar components are also located at an opposite longitudinal end. The chocks house bearing surfaces to rotatably support necked end portions of the work rolls.

A top work roll chock is indicated at 35 and a bottom work roll chock is indicated at 36 both located within the confines of paired rolling mill housing posts 37 and 38 (FIGS. 5 and 6) which provide vertical alignment for the rolls and their associated components as well as support for mill screw-down means. The rolling mill has paired housing posts on its operator side and paired housing posts on its drive side. In a preferred embodiment of the invention top work roll chock 35 has a single bending wing on each side of the chock each extending towards its neighboring housing post 37 or 38. Bending wing 39 is visible in FIG. 3, however, a wing hidden from view is also present on an opposite side of the chock located in mirror image about a plane defined by longitudinal axes 40 and 41. Such axes coincide with central axes of work rolls supported in the chocks.

Bottom chock 36, in the preferred embodiment, has two bending wings on each side of the chock indicated as 42, 43, 44 and 45 (FIG. 3) each extending towards its neighboring housing post 37 or 38 (FIGS. 5 and 6). The dimension of each wing in a direction of axis 41 is such that when the chocks are in close proximity to each other, as when rolling thin gauge material, wings of the top work roll chock, such as wing 39, can intermesh with wings 44, 45 of the bottom work roll chock (FIG. 3). Such intermeshing positioning is indicated by interrupted lines at 46. Such wings preferably extend upwardly then outwardly from bottom work roll chock 36; and extend downwardly then outwardly from top work roll chock 35 so when the chocks are at their closest proximity to each other during rolling, the intermeshed bending wings lie substantially in the same horizontal plane as best seen in FIGS. 5 and 6 at 47.

Each chock in general has a hexahedron shape, top work roll chock 35, best seen in FIG. 3, has side portion 48, face portion 49 and top portion 50. Similar portions, opposite portions 48, 49 and 50, are hidden from view. Bottom work roll chock 36 has similarly configured portions.

Referring to FIG. 3, bending wing 39 as well as its mirror image wing, are centered in relation to the bearing surfaces in the direction of longitudinal axis 40 so when bending forces are applied, they will be balanced longitudinally along the bearing surface so as to promote longer service life of the chock and bearing surfaces in comparison with non-balanced forces. In a similar manner bottom work roll wings 44 and 45 are located equal distance from the longitudinal center of the bearing surfaces so when equal forces are applied to each wing the bending forces are balanced. Such longitudinal center is in some cases substantially midway between the opposite face portions of each chock.

Bending forces are applied to the bending wings in the present embodiment through hydraulic cylinder and piston assemblies as depicted in FIGS. 4–6. The cylinders and pistons are housed in "C" blocks 51 and 52 which straddle the bending wings. The work roll bending system incorporates a pair of such "C" blocks at each longitudinal end of the work rolls. Pistons 53 and 54 (FIGS. 4 and 6) act on top work roll chock bending wing 39. Pistons 55, 56 and 57, 58 act on bottom work roll chock bending wings 45 and 44 respectively (FIGS. 4 and 5). Bending forces are applied through rods of the pistons which can contact the bending wings at force application indentations such as 39A (FIG. 3).

The cross-sectional area of piston 53, and other centrally positioned pistons for hydraulic pressure application, is equal to the combined cross-sectional area of pistons 55 and 57, and other pistons flanking the centrally positioned pistons (FIG. 4). For example, if the diameter of piston 53 is 7.0 inches, the diameter of each piston 55 and 57 is about 4.95 inches. The cross-sectional area over which hydraulic pressure is exerted would be about 154 $in^2$ for piston 53 alone and pistons 55 and 57 together. Such matching of cross-sectional area enables use of hydraulic fluid from a single source to each cylinder at the same pressure. Dimensions of the bending wings in the direction of axes 40 and 41 take into consideration the forces exerted on each wing from the hydraulic fluid pressure and bending wing strength requirements for such forces. For example, bending wing 39 is longer in such direction in comparison with bending wing 44 or 45 as it transfers twice the bending force to chock 35. A differing configuration wherein such pistons are not matched in cross-sectional area is possible in the invention. In another embodiment, if space in the direction of the work roll axes is available, the top work roll chock bending wing can be made wider and two pistons can be used to exert force on such bending wing (not shown). A configuration similar to that depicted in FIGS. 3–6, but modified such that the top work roll chock presents four bending wings and the bottom work roll chock presents two bending wings is also possible (not shown).

All of the cylinder and piston assemblies in the preferred embodiment are single-action and exert force in solely one direction. Directional arrows on the piston rods indicate the direction of applied force for pistons depicted in FIGS. 4–6. Positive work roll bending (smaller work roll gap near center of rolls) is carried out by activation of piston 54 to provide an upward force on wing 39 of the top work roll chock 35, and activation of pistons 55 and 57 to provide downward forces on wings 45 and 44 of the bottom work roll chock 36 (FIG. 4). Negative work roll bending (smaller work roll gap near ends of rolls) is carried out by activation of piston 53 to provide downward force on wing 39 of the top work roll chock 35 and activation of pistons 56 and 58 to provide upward forces on wings 45 and 44 of the bottom work roll chock 36. The shape of the work rolls when bending in a positive manner is depicted (exaggerated) in FIG. 4 by interrupted lines associated with work rolls 59 and 60. It is to be understood that operation of components associated with "C" block 52 is exemplified to disclose the invention and that the remaining three "C" blocks and associated components of the system are operated in a similar manner.

The roll bending system of the invention enables work roll bending, as achieved with prior practice apparatus, to be carried out in a space significantly smaller than that required with the prior practice. Such advantage enables conversion of existing rolling mills, designed without work roll bending capabilities, by retrofitting existing rolling mills with such work roll bending system. New rolling mill design is simplified with use of such compact system of the invention.

Prior practice roll bending systems depicted in FIGS. 1 and 2 can be compared with the system of the present invention (best seen in FIGS. 5 and 6) to compare the difference in vertical space requirements. As mentioned above, the vertical space is commonly limited by the bottom of the top back-up roll chock, and by the top of the bottom back-up roll chock. Such chocks are indicated in FIGS. 1 and 2 at 19, 20 and 33, 34 respectively and in FIGS. 5 and 6 at 61 and 62. In FIGS. 5 and 6, chocks 61 and 62 support bottom back up roll 63 and top back up roll 64 which are in contact with bottom work roll 60 and top work roll 59, respectively. Such contact is substantially line contact of roll surfaces at least over a portion of the rolls in an axial direction. For comparison of vertical space requirements of the various bending systems the travel length of all the pistons is assumed to be equal and depicted in the drawings as such. Referring to the roll bending system of FIG. 1, three "layers" of cylinders are required, indicated at 65, 66, and 67; and two "layers" of bending wings are required, at 68 and 69. In the system of FIG. 2, two layers of cylinders are required, at 70 and 71 and four layers of bending wings 72, 73, 74 and 75 are required. In comparison, the present embodiment (FIGS. 5 and 6) presents two layers of cylinders, 76, 77, and one layer of bending wings, 47. Bending wing thickness in the vertical direction can be about 9 inches; roll bending piston and cylinder assemblies housed within the various type blocks can be about 12 inches in the vertical direction. In the previous examples for comparison(systems depicted in FIGS. 1 and 2), a space savings of between about 21 to 27 inches can be realized. Such estimates can vary as many rolling mill dimensions and processing capacities are possible.

Such compactness in the vertical direction can, in some cases, provide sufficient space for auxiliary apparatus. Depicted in FIG. 5, at 78 and 79, are rollers to facilitate work roll replacement. Use of such rollers on work rolls of rolling mills is known in the art.

Although the prior practice apparatus as depicted in FIGS. 1 and 2, fits between back-up roll chocks 19 and 20 or 33 and 34, such is not always the case when retrofitting an existing rolling mill to provide work roll bending. In cases where vertical space does enable use of prior practice apparatus, replacement with the system of the present invention can enable use of roll bending hydraulic cylinders having a longer stroke so as to provide an increase in work roll gap. The present compact roll bending system can also improve access to other portions of the rolling mill and facilitate operations such as roll replacement.

While specific configurations and operations have been set forth for purposes of describing embodiments of the invention, various modifications can be resorted to, in light of the above teachings, without departing from the applicant's novel contributions; therefore, in determining the scope of the present invention reference shall be made to the appended claims.

What is claimed is:

1. In a rolling mill for profile control of continuous metal strip, having paired housing posts on each side of the rolling mill, a work roll bending system to achieve strip profiling, comprising:

a top and a bottom work roll for profile controlling engagement with the continuous metal strip;

work roll chocks retained for sliding vertically between paired housing posts to achieve work roll gap settings, and having bearing surfaces rotatably supporting longitudinal ends of the top and bottom work rolls;

at least one bending wing extending from each side of each work roll chock toward the nearest of the paired housing posts;

means acting through the bending wings for exerting bending forces on the work rolls;

each bending wing having a dimension and a disposition, in the direction of a central axis of the work roll being rotatably supported, such that during work roll bending operation:

top work roll chock bending wings and bottom work roll chock bending wings occupy the same horizontal plane without interference during at least some of the roll gap settings, and the bending forces are exerted on the bearing surfaces of each chock in a balanced manner along said central axis.

2. The work roll bending system of claim 1, wherein the work roll bending force means comprises hydraulically actuated piston and cylinder assemblies for exerting bending forces on the work rolls through the bending wings.

3. The work roll bending system of claim 1, wherein each top work roll chock bending wing is directed downwardly then outwardly from the chock toward its nearest housing post, each bottom work roll chock bending wing is directed upwardly then outwardly from the chock toward its nearest housing post, such that all the bending wings lie substantially within the same horizontal plane when the work rolls are positioned for metal strip thickness gauge reduction at a minimum working roll gap.

4. The work roll bending system of claim 1, further comprising work roll changing means operatively connected to the work roll chocks.

5. The work roll bending system of claim 1, wherein each top work roll chock presents at least two bending wings, at least one extending from the chock in a direction toward one of the paired housing posts and at least one extending from the chock in an opposite direction toward the other of the paired housing posts, and each bottom work roll chock presents at least four bending wings, at least two extending from the chock in a direction toward one of the paired housing posts and at least two extending from the chock in an opposite direction toward the other of the paired housing posts.

6. The work roll bending system of claim 1, wherein each bottom work roll chock presents at least two bending wings, at least one extending from the chock in a direction toward one of the paired housing posts and at least one extending from the chock in an opposite direction toward the other of the paired housing posts, and each top work roll chock presents at least four bending wings, at least two extending from the chock in a direction toward one of the paired housing posts and at least two extending from the chock in an opposite direction toward the other of the paired housing posts.

7. The work roll bending system of claim 2, further comprising blocks for housing said piston and cylinder assemblies.

8. The work roll bending system of claim 7, wherein a pair of blocks house piston and cylinder assemblies on each side of the rolling mill.

9. The work roll bending system of claim 8, wherein a set of three hydraulically actuated piston and cylinder assemblies are generally linearly disposed within each of an upper and lower portion of each block for exerting bending forces on the work rolls through three work roll chock bending wings.

10. The work roll bending system of claim 6, wherein the centrally located piston of each set has a cross-sectional area for exertion of hydraulic pressure substantially equal to the combined cross-sectional areas of the two flanking pistons.

11. The work roll bending system of claim 4, wherein said roll changing means are located within the confines of the paired housing posts of the rolling mill.

* * * * *